United States Patent [19]

Russell

[11] 4,418,541

[45] Dec. 6, 1983

[54] BOILER LOADING SYSTEM

[75] Inventor: Thomas D. Russell, Montville, Ohio

[73] Assignee: The Babcock & Wilcox Company, New Orleans, La.

[21] Appl. No.: 357,006

[22] Filed: Mar. 11, 1982

[51] Int. Cl.[3] ..... F01K 13/02

[52] U.S. Cl. ..... 60/667; 60/676; 122/448 B

[58] Field of Search ..... 60/664, 665, 667, 676; 122/448 B

[56] References Cited

U.S. PATENT DOCUMENTS 4,069,675 1/1978 Adler et al. ..... 60/676 X

*Primary Examiner*—Allen M. Ostrager

*Attorney, Agent, or Firm*—Vytas R. Matas; Robert J. Edwards

[57] ABSTRACT

A boiler loading system is disclosed which is used for loading one of a plurality of boilers in a power plant to satisfy a load demand. Each of the boilers is continuously monitored for an optimum efficiency change whether for a boiler load increase demand or boiler load decrease demand. The boiler with the largest efficiency change for a boiler load increase is selected to satisfy the plant demand and a boiler with the lowest efficiency change decrease is selected where the load demand is for a reduced load.

5 Claims, 3 Drawing Figures

BOILER LOADING SYSTEM

FIELD AND BACKGROUND OF THE INVENTION

The present invention relates in general to multiple boiler controls, and in particular to a new and useful boiler loading system which selects a single one of a plurality of boilers to be loaded which has an optimum efficiency characteristic.

Single power plants are often provided with a plurality of individual power generating elements such as a plurality of steam boilers. Where conditions in the output of the power plant change from a desired set point, it is necessary, from an energy management standpoint, to allocate loading of the various boilers to compensate for the change, in an economical manner. It is known to allocate such loading according to algorithms which follow complex mathematical models, and require a computer for implementation. Such an arrangement is known for example, from U.S. Pat. No. 4,069,675 to Alder et al.

Factors such as fuel consumption and costs and boiler efficiency are utilized in such a calculation.

While various techniques are known for ascertaining the efficiency of boilers, see U.S. Pat. Nos. 3,357,921 and 2,341,407 to Xenis et al, the implementation of boiler allocation has remained complex.

SUMMARY OF THE INVENTION

The present invention is drawn to a system which advantageously allocates boiler load to one of a plurality of boilers, using electronic or pneumatic analog control instrumentation without the necessity of providing complex algorithms or computer software for their implementation.

The inventive system requires only the monitoring of each boiler's fuel flow and load and the establishment for each boiler of an efficiency characteristic function which relates fuel cost to steam flow.

According to the invention, where a load increase or decrease requirement is determined, each of the boilers are examined for their efficiency characteristic under their prevailing load. With an overall load increase requirement, the boiler having the greatest efficiency for a corresponding increase is selected and controlled to provide the additional output required. Conversely, with a load decrease requirement, the boiler which has the lowest efficiency drop for a corresponding load reduction is selected.

In this manner the boiler which exhibits the most optimum efficiency characteristic for a particular situation is selected at all times to optimize the cost effectiveness of the power plant adjustment. In known fashion, the flow of one or more types of fuel and the flow of air to the boiler can be regulated to satisfy the power plant demand.

The demand of each boiler is monitored to detect operator selected biases and to determine which of the boilers are in an automatic mode. When an operator biases the boiler demand to one boiler, the other boilers will be readjusted in parallel to prevent a unit upset. Similarly when a boiler is base loaded, any deviation of its load demand from the ideal load setting is used to readjust the other boilers.

Each boiler's load is used to determine a magnitude of efficiency change for a load increase and a load decrease. The boiler's load is programmed to develop an expected efficiency rate. The actual boiler's load is biased a small amount, then run through the efficiency program to develop an index of efficiency for a load increase. The same procedure is also used to develop an index of efficiency for a load decrease. The expected efficiency for the actual boiler load is compared to the indeces of efficiency for both load increase and load decrease to determine a magnitude of efficiency change. This amount of efficiency change is utilized in the selection process as outlined above.

A calculation circuit is included to correct the magnitude of efficiency change. Each of the boiler's fuel flow is compared to the expected fuel flow based on actual boiler load. Any deviation between the two is used to generate a gain to make the expected amount of fuel flow match the measured fuel flow. This gain signal is also applied to the magnitude of efficiency change signals. Thus, if a boiler becomes more efficient (less fuel flow required) then expected, the magnitude of efficiency change is reduced. Where the boiler becomes less efficient the magnitude of efficiency change is increased.

The magnitude of efficiency change for all of the boilers (increases and decreases) are compared with each other. The boiler with the greatest efficiency increase has its load control integral released to accept any low throttle pressure error signals. In a similar manner, the boiler with the least efficiency decrease has its load control integral released to accept any high throttle pressure error signals. Proportional action from throttle pressure errors is applied to all boilers constantly for rapid response to load demands.

Accordingly an object of the present invention is to provide a boiler loading system and the method for a power plant having a plurality of boilers and operating at a desired load, the plant having an actual plant load and each boiler having an actual boiler load, comprising, sensing an actual plant load, comparing the actual plant load to the desired plant load to generate a plant change signal representing one of a plant load increase and a plant load decrease amount, monitoring each actual boiler load, determining a change in efficiency for each boiler with an incremental change in boiler load from an actual boiler load of each boiler respectively, to establish an efficiency increase for each boiler with an incremental boiler load increase and an efficiency decrease for each boiler with an incremental load decrease, and selecting that boiler with the highest efficiency increase when there is a plant load increase amount or the boiler with the lowest efficiency decrease when there is a plant load decrease amount. The selected boiler is then loaded by an amount corresponding to the plant load change signal, whether to increase or decrease the load of the boiler, to change the plant load.

Another object of the invention is to provide such a system and method wherein the actual load of the plant is determined using its system head pressure.

Another object of the invention is to compare an actual efficiency change with a predicted efficiency change utilizing fuel flow and boiler load quantities for each boiler.

A still further object of the invention is to provide a boiler loading system which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
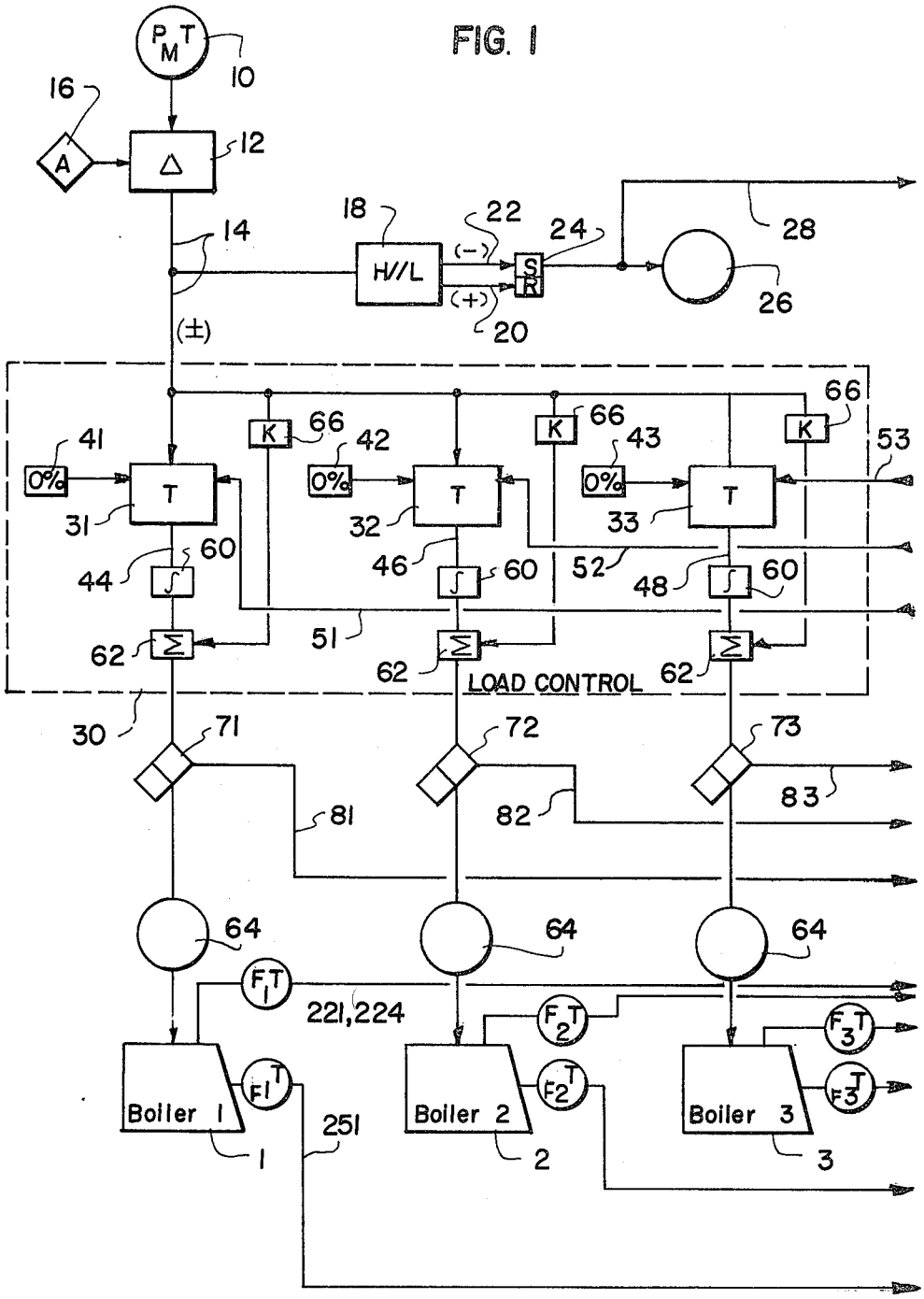
FIG. 1 is a block diagram of major components the boiler loading system according to the invention.

Referring to the drawings in particular, the invention embodied therein in FIG. 1 comprises an arrangement for allocating the loading of a plurality of boilers 1, 2 and 3. Any number of boilers can be provided in accordance with the invention and all generates steam which is used by the single multi unit power plant. The loading of the power plant is determined using a pressure transmitter 10 which transmits a signal corresponding to pressure of a common pressure head to a comparator 12. Comparator 12 generates a signal overlying 14 that corresponds to the difference between the actual loading or actual pressure signal from transmitter 10 and a desired loading level provided by element 16. Line 14 thus receives a plant load change signal. The signal is analyzed by high low analyzer 18 to determine whether a plant load increase (+) or plant load decrease (−) is present. The high low analyzer then provides an appropriate signal over a +line 20 or −line 22 to a flip flop 24 which has an output connected to an indicator 26 which indicates whether a load increase or decrease is required and a line 28 which sends the + or − logic signal to the circuit of FIG. 2 as will be described later.

The analog quantity for the load increase or decrease is provided to a load control unit 30 over line 14. The signal is applied to a transfer switch 31, 32 and 33. Each transfer switch is connected to its corresponding boilers 1,2 and 3. In the rest state, each transfer 31, 32 and 33 transmits a zero percent change signal from elements 41, 42 and 43 to the output side of each transfer labeled 44,46 and 48 respectively. Each transfer is provided with a control line 51, 52 and 53 which provides a control signal from the digital logic circuit of FIG. 2.

With a load increase or decrease is indicated, the analog logic circuit of FIG. 3, as will be described hereinunder, selects a boiler with optimum efficiency for that increase or decrease and a signal is generated on one of the lines 51, 52 and 53 to activate the appropriate transfer switch. Only upon such activation does the transfer switch apply the signal from line 14 to its output, over integrators 60 and summing elements 62, to controllers 64. The controllers operate a fuel flow valve for example to change the loading of the selected boiler 1, 2 or 3. The control circuit for each boiler is provided with an automatic or manually operable selector station 71, 72 and 73. Lines 81, 82 and 83 are provided for sending a signal, indicative of automatic operation, to the logic circuit of FIG. 2.

The appropriate loading signal is also enhanced by a signal amplifier 66, for each boiler control, which is connected to summing elements 62.

Figure 2:
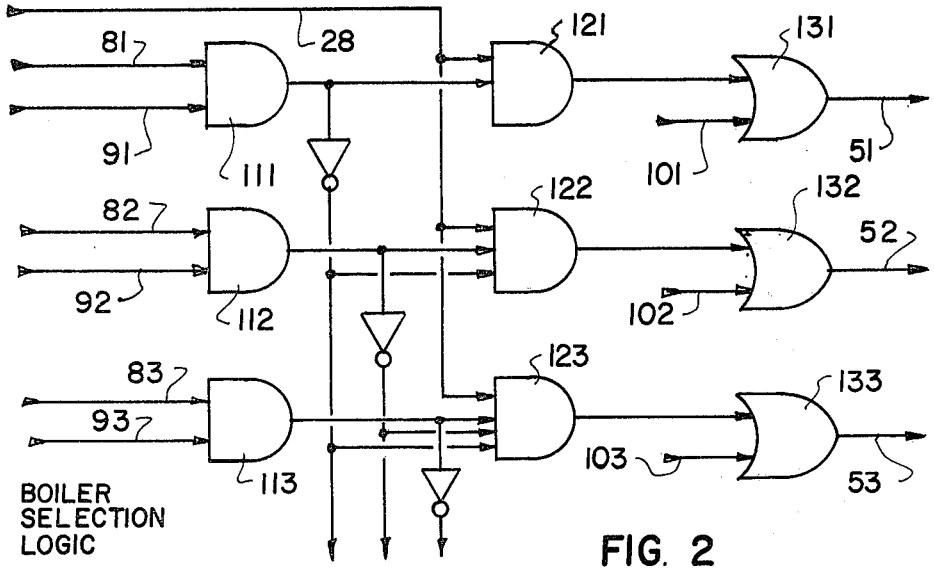
FIG. 2 is a block diagram of a boiler selection digitologic circuit used in the operation of the boiler loading system according to FIG. 1.

Referring now to FIG. 2, the boiler selection digital logic circuit comprises three first AND gates designated 111,112 and 113. Each And gate receives a first signal from the automatic manual station 71, 72 and 73 over lines 81, 82 and 83 respectively. This indicates automatic operation of the system. A second signal is supplied over one of lines 91, 92 and 93 which corresponds to the one boiler selected for a load change. Only the first AND gate with both inputs energized will produce a signal at its output which is applied to a second set of AND labelled 121, 122 and 123. A second input of each of the second AND gates is provided with a signal over line 28 which indicates either a load increase or load decrease requirement. The second AND gates 122 and 123 are also provided with additional inputs that supply a signal to the AND gates 122 and 123 corresponding to an inverted signal from gate 121 with respect to gate 122, and both gates 121 and 122 with respect to gate 123. In this way only a single one of the second AND gates 121,122 and 123 produces a positive output. Each of the second AND gates is connected to an OR gate 131,132 and 133. A second input of each of the OR gates is provided over lines 101, 102 and 103 which generates a signal in a manner similar to signals from 121,122,123 but for a load decrease. The selected OR gate provides a signal at its output with a signal either from one of the second AND gates 121, 122 or 123, or its other inputs 101, 102 or 103. The output signal of the OR gates is provided over lines 51, 52 or 53 to the respective transfer switches 31, 32 and 33. In this way, the digital logic circuit activates the transfer switch of the selected boiler.

Figure 3:
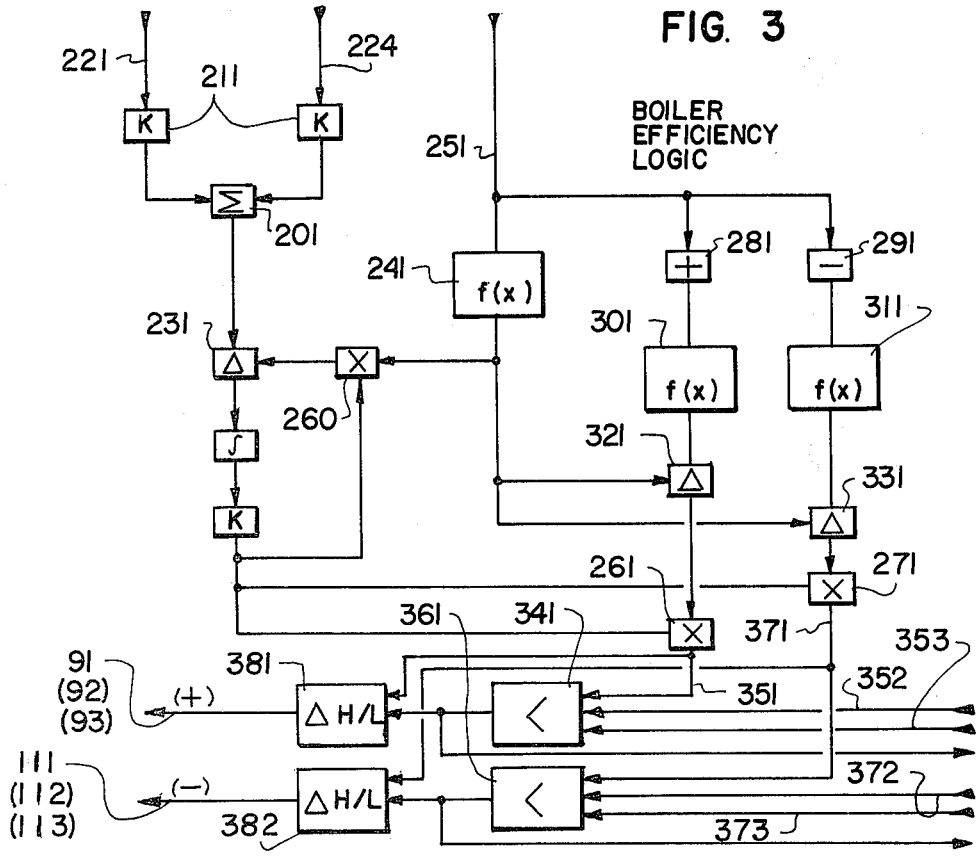
FIG. 3 is a boiler efficiency analog logic circuit used in the invention according to FIG. 1.

According to FIG. 3, an analog logic circuit is provided for each of the boilers. For simplicity only the circuit for boiler 1 is shown.

The circuit comprises a summing station 201 which receives a signal from proportioning stations 211 which factor an amount corresponding to a fuel price level. Each of the factor stations 211 receive signals over input lines 221 and 224. The signals on lines 221 and 224 represent flow amounts generated by a flow transmitter which is connected to each boiler, that senses a fuel flow for that boiler. In this way a fuel consumption amount can be obtained for the analog logic circuit. Two signals 221 and 224 are shown since one can correspond to a flow of oil fuel whereas the other one can correspond to a flow of gas fuel. In many cases only one signal corresponding to total fuel flow will be provided, however any number may be provided. The actual total cost of fuel being used is converted to a signal in summing station 201 which is provided to a difference station 231. The other input of difference station 231 is connected to the output of a function generator 241 which generates a value corresponding to a predicted fuel cost for a particular boiler load applied to it over line 251. As shown in FIG. 1, each of the boilers is provided with a flow transmitter for transmitting this value to its corresponding logic circuit.

The difference between the actual cost of fuel used and the predicted cost of fuel used is then supplied over an integrating and factoring element to multiplication stations 260, 261 and 271. This multiplication provides a correction to recognize any efficiency changes within the boiler. The boiler load signal overlying 251 is also applied to an adding element 281 and a subtracting element 291 which respectively add and subtract an incremental change in load, for example 5%. The thus changed load amount is applied to two additional function generators which also predict fuel cost, labelled 301 and 311. Difference elements 321 and 331 are provided at the outputs of the function generators 301 and 311 to compare their outputs with the cost factor for the unchanged boiler load, the difference thus generated is thus multiplied by the actual fuel correction used in multiplying stations 261 and 271, accounting for any deviation of fuel flow from design conditions (e.g. efficiency changes).

In this way, two efficiency change amounts are calculated for each boiler, an efficiency increase for incremental increase in boiler load and an efficiency decrease for an incremental decrease in boiler load. The efficiency increase is measured against efficiency increases from the analog logic circuit of the other boilers in a comparing station 341. The efficiency increase amount is provided to this element from the other boilers over lines 352 and 353. In a similar fashion, a comparing station 361 is provided for comparing efficiency decreases with the other boilers provided over lines 372 and 373. The efficiency increase and efficiency decrease of boiler 1 is provided over lines 351 and 371.

Only when comparing elements 351 and 361 determine that boiler 1 is actually the one with the optimum efficiency, either increase or decrease, a respective high low activator 381 or 382 is energized to provide appropriate signal over lines 91 or 111.

While a specific embodiment of the invention has been shown and described in detail to illustrate the application of the principles of the invention, it will be understood that the invention may be embodied otherwise without departing from such principles.

What is claimed is:

1. A boiler loading method for a power plant having a plurality of boilers and operable at a desired load, the plant having an actual plant load and each boiler having an actual boiler load, comprising:

sensing an actual plant load;

comparing the actual plant load with the desired plant load to generate a plant load change signal representing one of a plant load increase demand and a plant load decrease demand;

monitoring each actual boiler load;

determining a change in efficiency of each boiler with an incremental change in boiler load from each actual boiler load respectively, to establish an efficiency increase for each boiler load incremental increase and an efficiency decrease for each incremental boiler load decrease;

selecting the one of said boilers with the highest efficiency increase upon the occurrence of a plant load increase demand and the one of said boilers with the lowest efficiency decrease upon the occurrence of a plant load decrease demand; and loading the one of said boilers which is selected by an amount corresponding to the plant load change signal for satisfying the one of the plant load increase demand plant load decrease demand.

2. A method according to claim 1, including determining the change in efficiency for each boiler by monitoring an amount of fuel used by each boiler at the actual boiler load for each boiler, comparing the amount of fuel used to a predicted amount of fuel used obtained from a characteristic fuel cost efficiency for each boiler to obtain an efficiency error signal, and multiplying the efficiency increase and efficiency decrease by the error signal.

3. A method according to claim 1, including sensing the pressure of a common pressure head for all the boilers of the power plant to obtain an amount corresponding to the actual plant load.

4. A boiler loading system for a power plant having a plurality of boilers and operable at a desired load, the plant having an actual plant load and each boiler having an actual boiler load, comprising:

means for sensing an actual plant load;

means for comparing the actual plant load to the desired plant load to obtain a load change signal representing one of a plant load increase demand and a plant load decrease demand;

a load control connected to said means for sensing and to each of said boilers for applying a signal corresponding to the plant load change signal into one of said boilers for controlling said one of said boilers to satisfy the one of the plant load increase and decrease amounts;

high-low sensing means for generating a first logic signal whenever a plant load change signal occurs;

a first logic circuit connected to said high-low sensing means and to said load control, having a plurality of inputs each corresponding to one of the boilers, operable when receiving a signal over one of said inputs to activate the loading of a corresponding one of the boilers; and a second logic circuit connected to each of the boilers having at least one output connected to each respective one of said first logic circuit inputs, each second logic circuit operating to determine an efficiency change increase and an efficiency change decrease for incremental load increases and decreases respectively; and a boiler load sensor connected between each boiler and each respective second logic circuit.

5. A system according to claim 4, wherein said first logic circuit comprises a plurality of AND gate equal in number to the boilers each having one input connected to said high-low sensing means and another input connected to the at least one output of each second logic circuit, a plurality of OR gates equal in number to said AND gates each having one input connected to an output of each AND respectively and a second input connected to a second output of each second logic circuit respectively, said first mentioned output of each second logic circuit generating a signal upon the occurrence in that second logic circuit of a maximum efficiency change increase among all the boilers, and said additional output of each second logic circuit generating a signal upon the occurrence of a maximum efficiency change decrease.

* * * * *